US011111738B2

(12) United States Patent
El Mallawany et al.

(10) Patent No.: US 11,111,738 B2
(45) Date of Patent: Sep. 7, 2021

(54) RELEASABLE CONNECTION MECHANISM FOR USE WITHIN A WELL

(71) Applicant: HALLIBURTON ENERGY SERVICES, INC., Houston, TX (US)

(72) Inventors: Ibrahim El Mallawany, Spring, TX (US); Lorenzzo B. Minassa, Tomball, TX (US); Henry P. Lindner, Jr., The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/890,719

(22) Filed: Aug. 4, 2020

(65) Prior Publication Data

US 2020/0355033 A1 Nov. 12, 2020

Related U.S. Application Data

(62) Division of application No. 15/816,623, filed on Nov. 17, 2017, now Pat. No. 10,704,339.

(51) Int. Cl.
*E21B 17/06* (2006.01)
*E21B 23/04* (2006.01)

(52) U.S. Cl.
CPC ..... *E21B 17/06* (2013.01); *E21B 23/04* (2013.01)

(58) Field of Classification Search
CPC ..... E21B 17/06; E21B 17/046
See application file for complete search history.

(56) References Cited

U.S. PATENT DOCUMENTS 2,887,163 A * 5/1959 McGowen, Jr. ..... E21B 23/02 166/217
4,391,326 A * 7/1983 Greenlee ..... E21B 17/06 166/217
4,601,492 A * 7/1986 George ..... E21B 17/06 137/68.17
4,638,860 A * 1/1987 Magee, Jr. ..... E21B 17/06 166/114
4,911,237 A * 3/1990 Melenyzer ..... E21B 17/06 166/208
4,913,229 A * 4/1990 Hearn ..... E21B 17/06 166/156
4,949,791 A * 8/1990 Hopmann ..... E21B 17/06 166/378
5,004,272 A * 4/1991 Kipp ..... B63B 21/502 285/24

(Continued)

*Primary Examiner* — Steven A MacDonald
(74) *Attorney, Agent, or Firm* — Chamberlain Hrdlicka

(57) ABSTRACT

A releasable connection mechanism for use downhole with a tubular member includes a collet, a collet stop, and a ring housing. The collet is configured to engage the tubular member, the collet stop is axially movable with respect to the collet between a disengaged position to not engage the collet and an engaged position to engage the collet, and the ring housing is selectively axially movable with respect to the collet. In the disengaged position, the collet is configured to move with respect to the ring housing to engage the ring housing and prevent the collet from disengaging the tubular member when the collet is tensioned with respect to the tubular member. In the engaged position, the collet is configured to remain axially stationary with respect to the ring housing and disengage the tubular member when the collet is tensioned with respect to the tubular member.

19 Claims, 7 Drawing Sheets

(56) References Cited

U.S. PATENT DOCUMENTS

| | | | | | |
|---|---|---|---|---|---|
| 5,370,186 | A * | 12/1994 | Ireland | E21B 17/06 | 166/212 |
| 5,462,121 | A * | 10/1995 | Schmuck | E21B 23/00 | 166/383 |
| 6,131,663 | A * | 10/2000 | Henley | E21B 23/006 | 166/373 |
| 6,571,879 | B1 * | 6/2003 | Bebak | E21B 17/028 | 166/105 |
| 7,225,880 | B2 * | 6/2007 | Braddick | E21B 43/106 | 166/382 |
| 8,464,788 | B2 * | 6/2013 | Stanford | E21B 17/06 | 166/242.6 |
| 9,267,338 | B1 * | 2/2016 | LeBlanc | E21B 23/04 | |
| 2010/0282474 | A1 * | 11/2010 | Mohr | E21B 33/038 | 166/360 |
| 2011/0232898 | A1 * | 9/2011 | Pendleton | E21B 23/12 | 166/180 |
| 2013/0153203 | A1 * | 6/2013 | Lauderdale | E21B 17/06 | 166/55 |
| 2013/0153207 | A1 * | 6/2013 | Lauderdale | E21B 23/02 | 166/123 |
| 2014/0110129 | A1 * | 4/2014 | Schmidt | E21B 23/04 | 166/377 |
| 2015/0060086 | A1 * | 3/2015 | Saurer | E21B 23/02 | 166/382 |

* cited by examiner

RELEASABLE CONNECTION MECHANISM FOR USE WITHIN A WELL

BACKGROUND

This section is intended to provide relevant contextual information to facilitate a better understanding of the various aspects of the described embodiments. Accordingly, it should be understood that these statements are to be read in this light and not as admissions of prior art.

Wellbores are drilled into subterranean formations for the potential recovery of hydrocarbons. Some wellbore servicing methods employ tubular members, tools, and other assemblies that are conveyed within the wellbore for various purposes throughout the life of the wellbore, such as producing the hydrocarbons from the wellbore. The wellbore tubular members and tools may also be retrieved from the wellbore for a variety of purposes. For example, the wellbore tubular member may be retrieved from the wellbore in order to replace or repair the wellbore tubular member, to perform a servicing operation on the subterranean formation, or to abandon the wellbore. Each time the wellbore tubular member is placed into the wellbore or retrieved from the wellbore, the wellbore and/or the wellbore tubular member may be damaged, with the costs for repairing such damage increasing due to the downtime of the wellbore.

Therefore, it will be appreciated that advancements in the art of deploying and retrieving tubular members, tools, and other assemblies in a well would be desirable in the circumstances mentioned above, and such advancements would also be beneficial in a wide variety of other circumstances.

BRIEF DESCRIPTION OF THE DRAWINGS

Illustrative embodiments of the present disclosure are described in detail below with reference to the attached drawing figures, which are incorporated by reference herein and wherein.

The illustrated figures are only exemplary and are not intended to assert or imply any limitation with regard to the environment, architecture, design, or process in which different embodiments may be implemented.

DETAILED DESCRIPTION OF ILLUSTRATIVE EMBODIMENTS

The present disclosure generally relates to oil and gas exploration and production, and more particularly to a mechanism or system to deploy or retrieve tubular members, tools, or other assemblies within a well.

Oil and gas hydrocarbons are naturally occurring in some subterranean formations. A subterranean formation containing oil or gas may be referred to as a reservoir, in which a reservoir may be located under land or off shore. Reservoirs are typically located in the range of a few hundred feet (shallow reservoirs) to a few tens of thousands of feet (ultra-deep reservoirs). To produce oil or gas, a wellbore is drilled into a reservoir or adjacent to a reservoir.

A well can include, without limitation, an oil, gas, or water production well, or an injection well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet of the wellbore. As used herein, "into a well" means and includes into any portion of the well, including into the wellbore or into the near-wellbore region via the wellbore.

A portion of a wellbore may be an open-hole or cased-hole. In an open-hole wellbore portion, a tubing string may be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include, but are not limited to: the space between the wellbore and the outside of a tubing string in an open-hole wellbore; the space between the wellbore and the outside of a casing in a cased-hole wellbore; and the space between the inside of a casing and the outside of a tubing string in a cased-hole wellbore.

Figure 1:
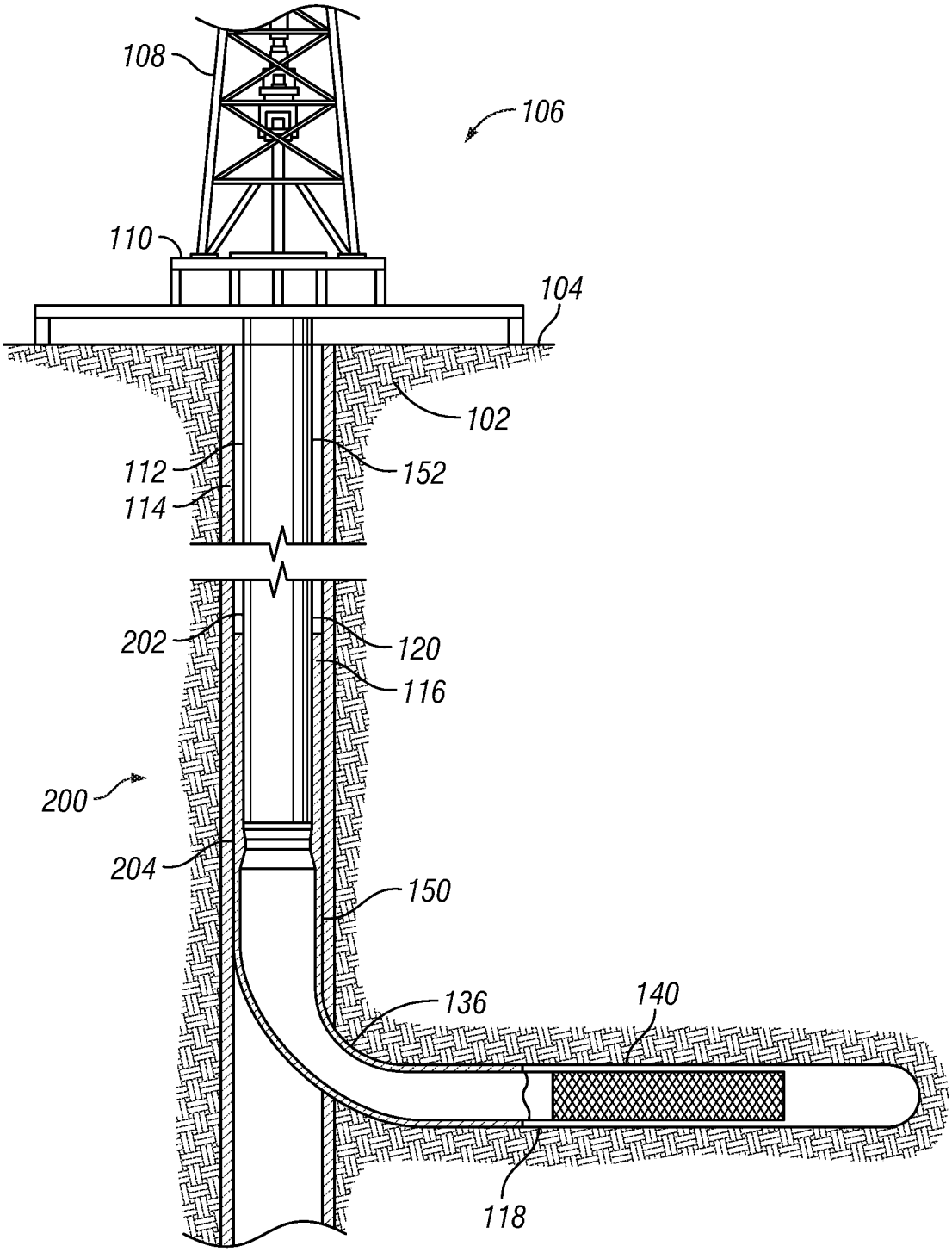
FIG. 1 shows schematic view of a well system in accordance with one or more embodiments of the present disclosure.

Referring now to FIG. 1, an example of a wellbore operating environment in accordance with one or more embodiments of the present disclosure is shown. As depicted, the operating environment shows a drilling rig 106 that is positioned on the earth's surface 104 and extends over and around a wellbore 114 that penetrates a subterranean formation 102 for the purpose of recovering hydrocarbons. The wellbore 114 may be drilled into the subterranean formation 102 using any suitable drilling technique. The wellbore 114 extends substantially vertically from the earth's surface 104 over a vertical wellbore portion 116, deviates from vertical relative to the earth's surface 104 over a deviated wellbore portion 136, and transitions to a horizontal wellbore portion 118. In alternative operating environments, all or portions of a wellbore may be vertical, deviated at any suitable angle, horizontal, and/or curved.

The wellbore may be a new wellbore, an existing wellbore, a straight wellbore, an extended reach wellbore, a side-tracked wellbore, a multi-lateral wellbore, and other types of wellbores for drilling and completing one or more production zones. Further the wellbore may be used for both producing wells and injection wells.

A wellbore tubular string 120 including a releasable connection mechanism 200 may be lowered into the subterranean formation 102 for a variety of servicing or treatment procedures throughout the life of the wellbore. The embodiment shown in FIG. 1 shows the wellbore tubular string 120 in the form of a production tubing string being lowered into the subterranean formation with an upper running tool 202 engaging a lower downhole tool 204 or tubular through the releasable connection mechanism 200. It should be understood that the wellbore tubular string 120 including the releasable connection mechanism 200 is equally applicable to any type of wellbore tubular string or tubular member being inserted into a wellbore, including as non-limiting examples production tubing and coiled tubing. The releasable connection mechanism 200 may also be used to connect and provide a hydraulic pathway for various other downhole components (e.g., various downhole subs, pumps, and servicing tools). For example, the wellbore tubular string 120 including the upper running tool 202 may be conveyed into the subterranean formation 102 to engage the downhole tool 204 to thereby establish one or more pathways (e.g., hydraulic pathways) through the releasable connection mechanism 200.

The drilling rig 106 includes a derrick 108 with a rig floor 110 through which the wellbore tubular string 120 extends downward from the drilling rig 106 and into the wellbore 114. The drilling rig 106 has a motor driven winch and other associated equipment for extending the wellbore tubular string 120 into the wellbore 114, and to position the wellbore tubular string 120 within the wellbore 114. While the operating environment depicted in FIG. 1 refers to a stationary drilling rig 106 for lowering and positioning the wellbore tubular string 120 including the releasable connection mechanism 200 within a land-based wellbore 114, alternatively, mobile workover rigs, wellbore servicing units (such as coiled tubing units), and the like may be used to lower the wellbore tubular string 120 including the releasable connection mechanism 200 into a wellbore. It should be understood that a wellbore tubular string 120 including the releasable connection mechanism 200 may alternatively be used in other operational environments, such as within an offshore wellbore operational environment. In alternative operating environments, a vertical, deviated, or horizontal wellbore portion may be cased and cemented and/or portions of the wellbore may be uncased. For example, the uncased section 140 may include a section of the wellbore 114 ready for being cased or used as an open-hole production zone. In an embodiment, a wellbore tubular string 120 including the releasable connection mechanism 200 may be used in a cased or uncased wellbore. Regardless of the type of operational environment in which the wellbore tubular string 120 with the releasable connection mechanism 200 is used, it will be appreciated that the releasable connection mechanism 200 serves to provide a releasable connection with other tubular members, downhole tools, or assemblies within the wellbore 114. Further, the releasable connection mechanism 200 may allow for one or more hydraulic, electric, or fiber optic pathways to be established between the upper running tool 202 and the lower downhole tool 204.

Figure 2:
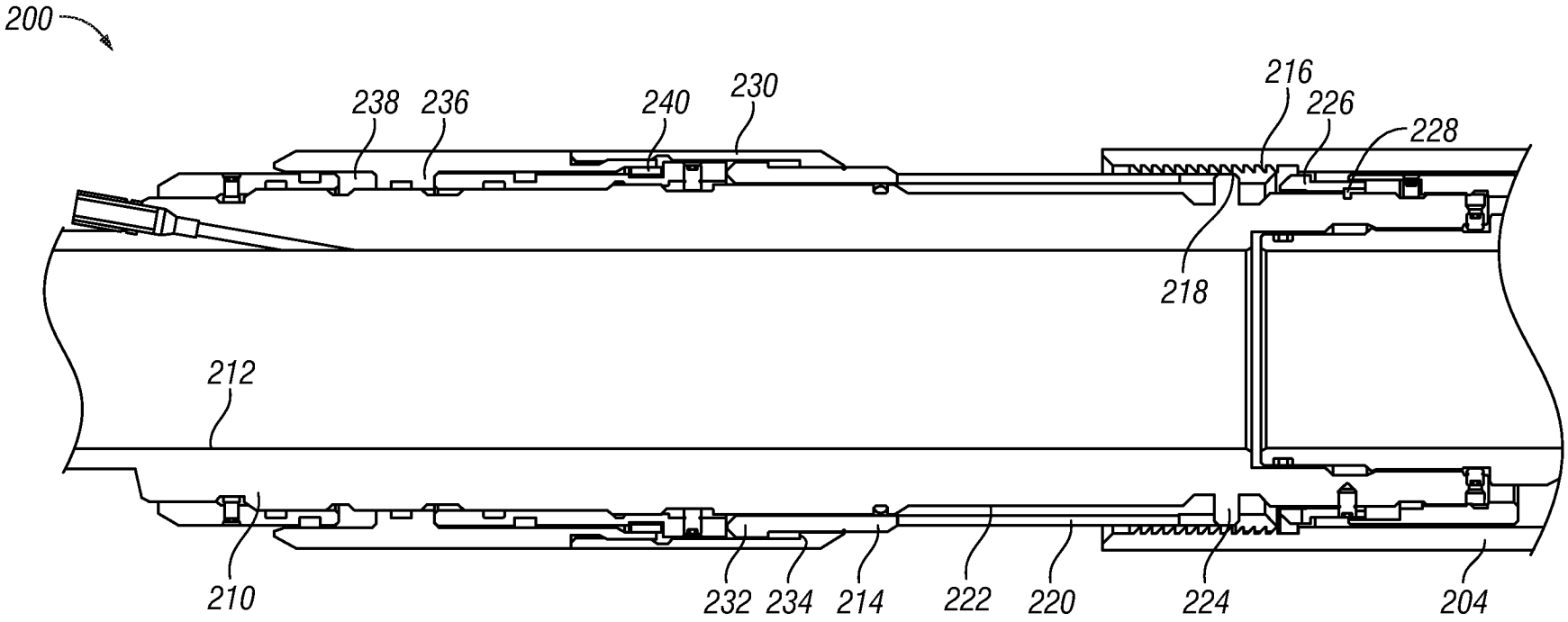
FIG. 2 shows a cross-sectional view of a releasable connection mechanism in accordance with one or more embodiments of the present disclosure.
Figure 3:
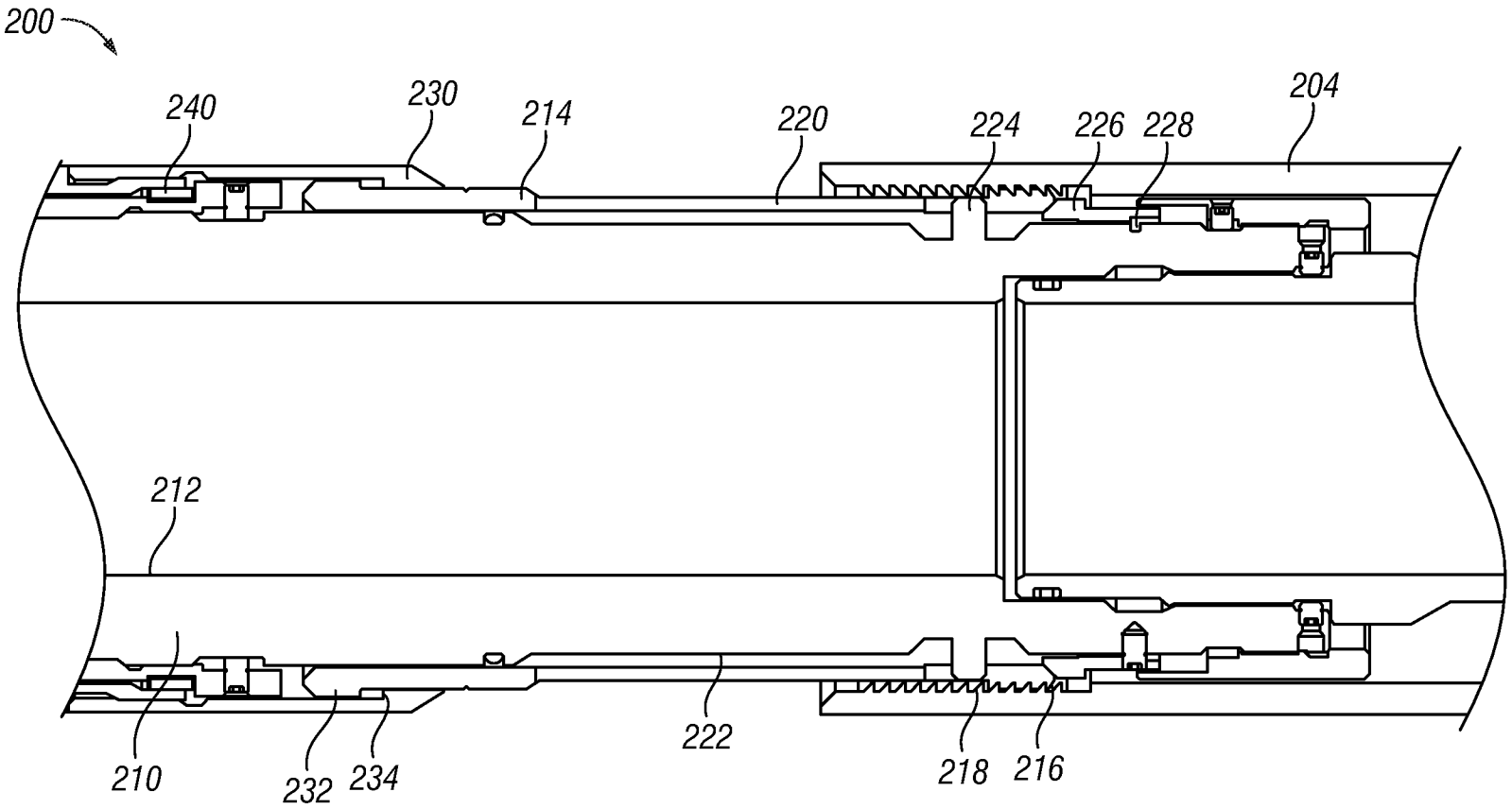
FIG. 3 shows a cross-sectional view of the releasable connection mechanism in FIG. 2 in accordance with one or more embodiments of the present disclosure.
Figure 4:
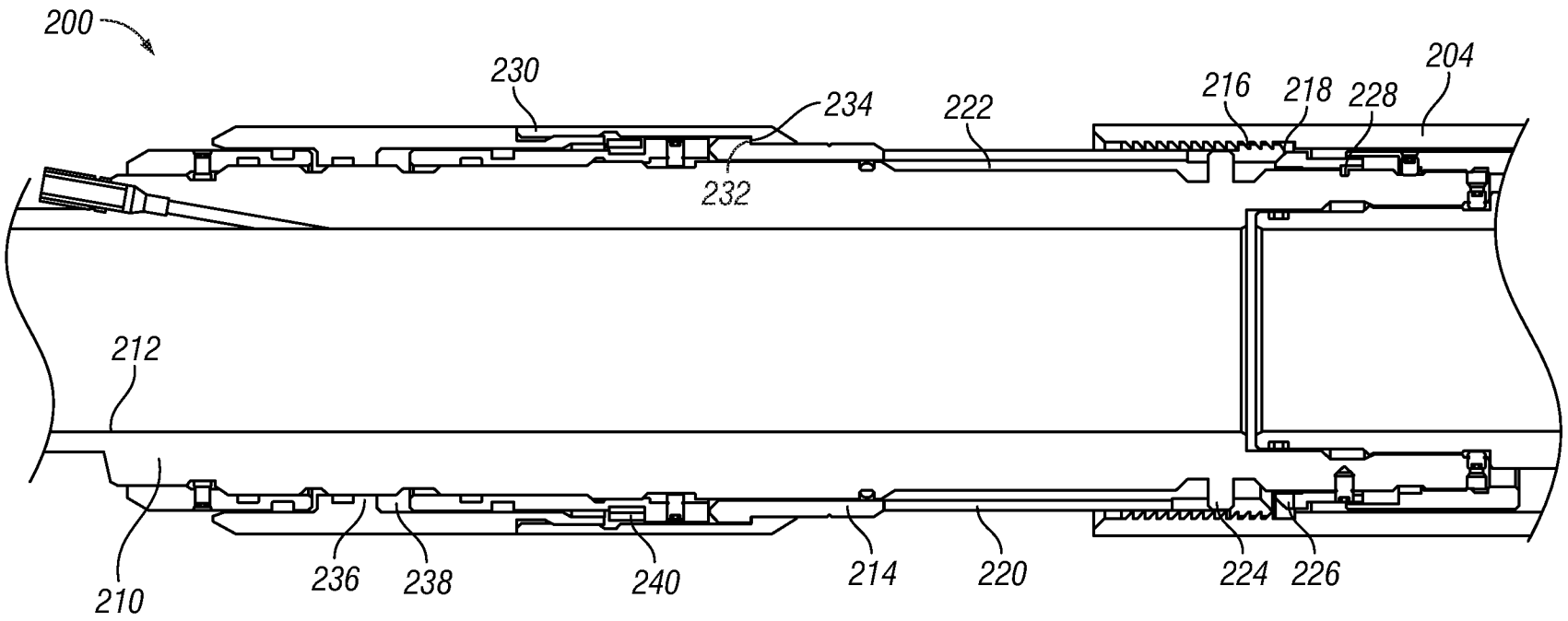
FIG. 4 shows a cross-sectional view of the releasable connection mechanism in FIG. 2 in accordance with one or more embodiments of the present disclosure.

Referring now to FIGS. 2-4, multiple views of a releasable connection mechanism 200 for disconnecting from a downhole tool 204 in accordance with one or more embodiments of the present disclosure are shown. In particular, FIG. 2 shows the releasable connection mechanism 200 in a disengaged position or anchored positioned with no tension applied across the releasable connection mechanism 200 and the downhole tool 204. FIG. 3 shows the releasable connection mechanism 200 in the disengaged position and with tension applied across the releasable connection mechanism 200 and the downhole tool 204. FIG. 4 shows the releasable connection mechanism 200 in an engaged position or releasable position and with no tension applied across the releasable connection mechanism 200 and the downhole tool 204. Further, though this embodiment generally refers to the releasable connection mechanism 200 engaging with the downhole tool 204, the present disclosure is not so limited, as the releasable connection mechanism 200 may be used to connect and disconnect (e.g., anchor or release) with other components (e.g., a tubular member, a downhole assembly, etc.).

The releasable connection mechanism 200 is generally defined about an axis and includes a mandrel 210 with a flow passage 212 formed through the mandrel 210. A collet 214 is carried on the mechanism 200 and is positioned about the mandrel 210. The collet 214 includes an engagement surface 216 that is used to engage and mate with a corresponding engagement surface 218 of the downhole tool 204. The engagement surfaces 216 and 218 may be a ratchet-latch type of engagement, as shown. Thus, one of the engagement surfaces 216 and 218 may include teeth (e.g., the collet engagement surface 216 in this embodiment), and the other one of the engagement surfaces 216 and 218 may include corresponding teeth or a threaded surface (e.g., the downhole tool engagement surface 218 in this embodiment). Further, as the collet 214 is shown at least partially positioned within the downhole tool 204 in this embodiment, the collet engagement surface 216 may be formed on an outer surface at an end of the collet 214, and the downhole tool engagement surface 218 may be formed on an inner surface at an end of the downhole tool 204.

The collet 214 may be radially flexible (e.g., radially compressible and/or expandable) with respect to the mandrel 210 or the downhole tool 204, for the engagement surfaces 216 and 218 to engage and disengage with each other. For example, the collet 214 includes a plurality of slots to define a plurality of fingers 220 with the collet engagement surface 216 formed upon the fingers 220 to facilitate the collet 214 flexing or bending with respect to the downhole tool 204 or with respect to the mandrel 210. Further, a recess 222 may be formed between the collet 214 and the mandrel 210, such as by having the recess 222 formed on an outer surface of the mandrel 210, to enable the collet 214 to deflect and bend radially inward into the recess 222 when flexing.

The collet 214 may be able to move axially with respect to the mandrel 210. Further, though not necessary, the collet 214 may be rotationally constrained with respect to the mandrel 210 such that the collet 214 is not able to rotate about or with respect to the mandrel 210. For example, as shown, the mandrel 210 may include one or more tabs 224 that protrude into or through the slots of the collet 214 and between the fingers 220, preventing rotation but enabling axial movement between the collet 214 and the mandrel 210.

The releasable connection mechanism 200 includes a ring housing 226. The ring housing 226 is positioned about the mandrel 210 and within the downhole tool 204 in this embodiment. Further, a shearable element, such as a shear ring 228, is positioned between the mandrel 210 and the ring housing 226 that prevents axial movement between mandrel 210 and the ring housing 226. The shear ring 228 will shear when a predetermined amount of force is applied to the shear ring 228 to then enable the ring housing 226 to move axially with respect to the mandrel 210.

Referring still to FIGS. 2-4, the releasable connection mechanism 200 further includes a collet stop 230 positioned about the mandrel 210 and at least partially about an end of the collet 214. The collet stop 230 is axially movable with respect to the mandrel 210 and the collet 214, such as between a disengaged position and an engaged position. FIGS. 2 and 3 show the collet stop 230 in the disengaged position with respect to the collet 214, and FIG. 4 shows the collet stop 230 in the engaged position with respect to the collet 214. In this embodiment, the collet 214 includes a shoulder 232, and the collet stop 230 includes a corresponding shoulder 234. In the disengaged position, the collet stop 230 may contact, but does not engage the collet 214. For example, in the disengaged position, even though the collet stop 230 may engage the collet 214 (e.g., slidingly engage), the collet stop 230 and the collet 214 are axially movable with respect to each other, and further the collet 214 is axially movable with respect to the mandrel 210. In the engaged position, the collet stop 230 engages and contacts the collet 214 to prevent axial movement between the collet stop 230 and the collet 214, and to prevent axial movement between the collet 214 and the mandrel 210. In particular, in the engaged position, the collet stop shoulder 234 engages and contacts the collet shoulder 232 to prevent axial movement (in one direction) of the collet 214 and the collet stop 230 with respect to each other.

In one or more embodiments of the present disclosure, the collet stop 230 may be mechanically actuated, hydraulically actuated, pneumatically actuated, and/or electrically actuated to move the collet stop 230 with respect to the collet 214 and/or the mandrel 210. For example, in FIGS. 2-4, the collet stop 230 is hydraulically actuated to move with respect to the collet 214 and the mandrel 210. In this embodiment, a piston 236 is positioned within a chamber 238 formed about the mandrel 210 with the piston 236 coupled to the collet stop 230. Pressurized fluid is provided to one side (e.g., downstream side) of the piston 236 to move the collet stop 230 from the disengaged position to the engaged position, and is provided to the other side (e.g., upstream side) of the piston 236 to move the collet stop 230 from the engaged position to the disengaged position.

As mentioned above, the releasable connection mechanism 200 may be used to selectively disconnect from the downhole tool 204. In FIGS. 2-4, the releasable connection mechanism 200 is connected to the downhole tool 204 through the engagement of the engagement surfaces 216 and 218. FIG. 2 shows the collet stop 230 in the disengaged position with respect to the collect 214 and with no tension applied between the releasable connection mechanism 200 and the downhole tool 204. FIG. 3 then shows the collet stop 230 still in the disengaged position, but now with tension applied between the releasable connection mechanism 200 and the downhole tool 204. Tension, for instance, may be applied between the releasable connection mechanism 200 and the downhole tool 204, such as when deploying the downhole tool 204 in the wellbore with the releasable connection mechanism 200. As shown in FIG. 3, with tension applied, the collet 214 is axially stationary with respect to the downhole tool 204, but the mandrel 210 and the ring housing 226 move axially with respect to the collet 214 and downhole tool 204. For example, the gap previously defined or formed between the collet 214 and the ring housing 226 in FIG. 2 is smaller or non-existent in FIG. 3. This enables the collet 214 to engage and contact the ring housing 226 in FIG. 3 and increase the compression forcing engagement surfaces 216 and 218 against each other. In particular, a tapered or angled end surface of the collet 214 contacts a corresponding tapered or angled end surface of the ring housing 226. This engagement between the collet 214 and the ring housing 226 prevents the collet engagement surface 216 from disengaging the downhole tool engagement surface 218. Further, this engagement prevents the releasable connection mechanism 200 from disconnecting from the downhole tool 204, even when tension is applied to the releasable connection mechanism 200 with respect to the downhole tool 204, such as when deploying or moving the downhole tool 204 with the releasable connection mechanism 200. Thus, when the collet stop 230 is in the disengaged position with respect to the collect 214 and tension is applied between the releasable connection mechanism 200 and the downhole tool 204, the collet 214 engages the ring housing 226, thereby preventing the collet engagement surface 216 from disengaging the downhole tool engagement surface 218 and preventing the releasable connection mechanism 200 from disconnecting from the downhole tool 204.

Figure 5:
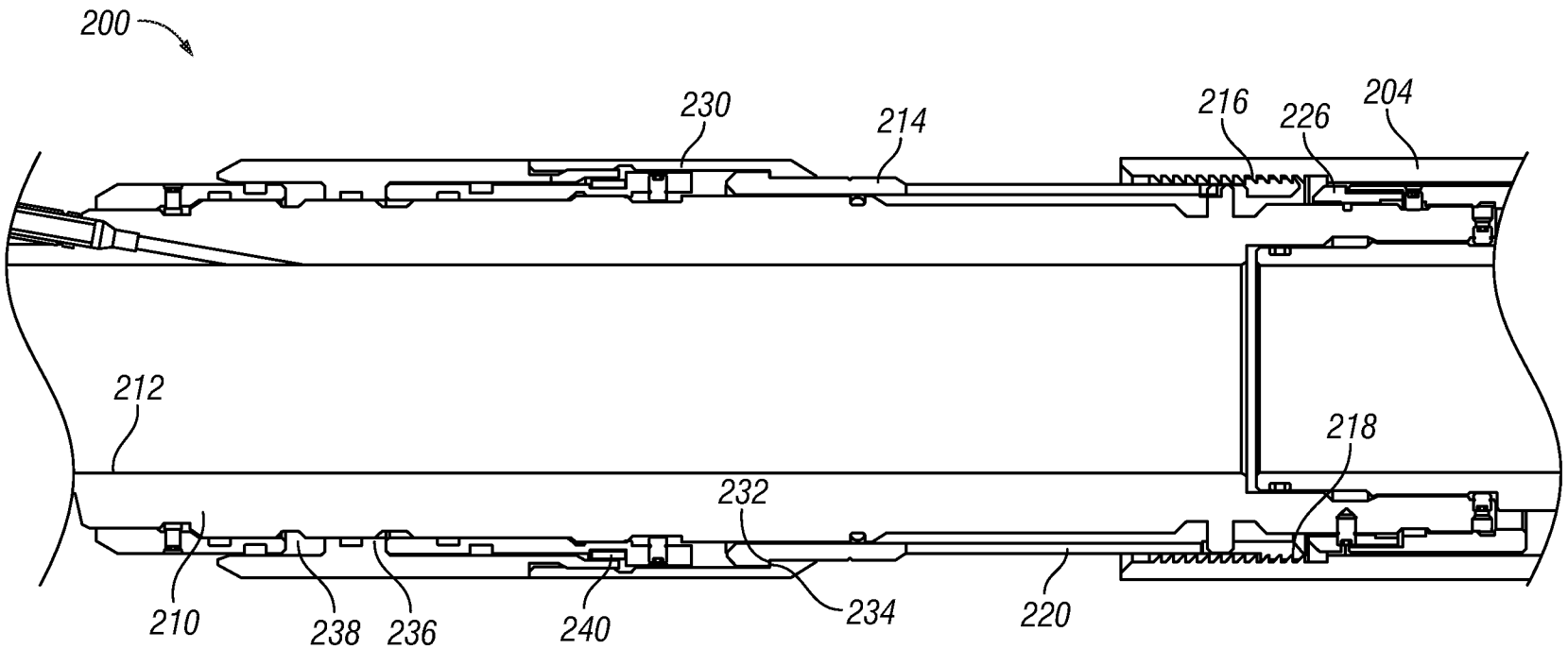
FIG. 5 shows a cross-sectional view of the releasable connection mechanism in FIG. 2 in accordance with one or more embodiments of the present disclosure.

As shown and discussed above, when the collet stop 230 is in the disengaged position and tension is applied between the releasable connection mechanism 200 and the downhole tool 204, the ring housing 226 is able to prevent the collet engagement surface 216 from disengaging the downhole tool engagement surface 218. However, in one or more embodiments, if enough tension (e.g., above a predetermined amount) is applied between the releasable connection mechanism 200 and the downhole tool 204, the collet engagement surface 216 may be able to disengage from the downhole tool engagement surface 218 to enable the releasable connection mechanism 200 to disconnect from the downhole tool 204. For example, the ring housing 226 is connected to the mandrel 210 through a shear ring 228. Once a predetermined amount of shear is experienced by the shear ring 228, the shear ring 228 will shear to enable the ring housing 226 to move with respect to mandrel 210, as shown in FIG. 5. This arrangement prevents the ring housing 226 from engaging the collet 214, and thus the collet engagement surface 216 is able to disengage from the downhole tool engagement surface 218 and the releasable connection mechanism 200 is able to disconnect from the downhole tool 204.

FIG. 4 shows the collet stop 230 in the engaged position without tension applied between the releasable connection mechanism 200 and the downhole tool 204. With the collet stop 230 in the engaged position, the collet stop 230 prevents any axial movement between the collet 214, the mandrel 210, and the ring housing 226. This engagement between the collet stop 230 and the collet 214 maintains the gap defined or formed between the collet 214 and the ring housing 226, such as even when tension is applied between the releasable connection mechanism 200 and the downhole tool 204. Accordingly, in the embodiment in FIG. 4, when tension is applied between the releasable connection mechanism 200 and the downhole tool 204, the collet stop 230 prevents engagement and contact between the collet 214 and the ring housing 226. In such an embodiment, the collet engagement surface 216 is free to deflect radially inward and is thus able to disengage from the downhole tool engagement surface 218, such as from the fingers 220 of the collet 214 deflecting radially inward and away from the downhole tool 204. The releasable connection mechanism 200 is then able to disconnect from the downhole tool 204. Thus, when the collet stop 230 is in the engaged position and tension is applied between the releasable connection mechanism 200 and the downhole tool 204, the collet 214 no longer engages the ring housing 226, thereby enabling the collet engagement surface 216 to disengage from the downhole tool engagement surface 218 and enabling the releasable connection mechanism 200 to disconnect from the downhole tool 204.

In one or more embodiments of the present disclosure, the collet stop 230 may be able to be locked in the engaged position to prevent movement of the collet stop 230 towards the disengaged position. For example, a snap ring 240 may engage with the collet stop 230 or a component coupled to the collet stop 230 to lock the collet stop 230 in the engaged position. FIGS. 2 and 3 show the snap ring 240 in a collapsed position, thereby enabling movement of the collet stop 230 with respect to the mandrel 210 and collet 214. However, once the collet stop 230 moves to the engaged position, shown in FIG. 4, the snap ring 240 may expand to engage the collet stop 230. Once the snap ring 240 is in the expanded position in FIG. 4, the collet stop 230 may be locked in the engaged position to prevent movement of the collet stop 230 back towards the disengaged position.

Figure 6:
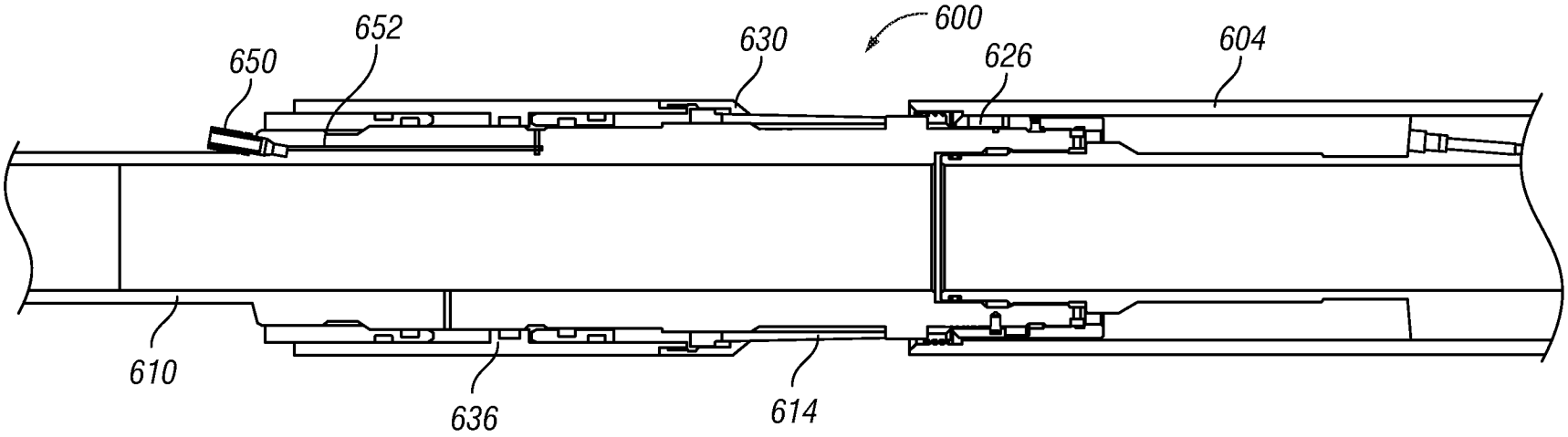
FIG. 6 shows a cross-sectional view of a releasable connection mechanism in accordance with one or more embodiments of the present disclosure.
Figure 7:
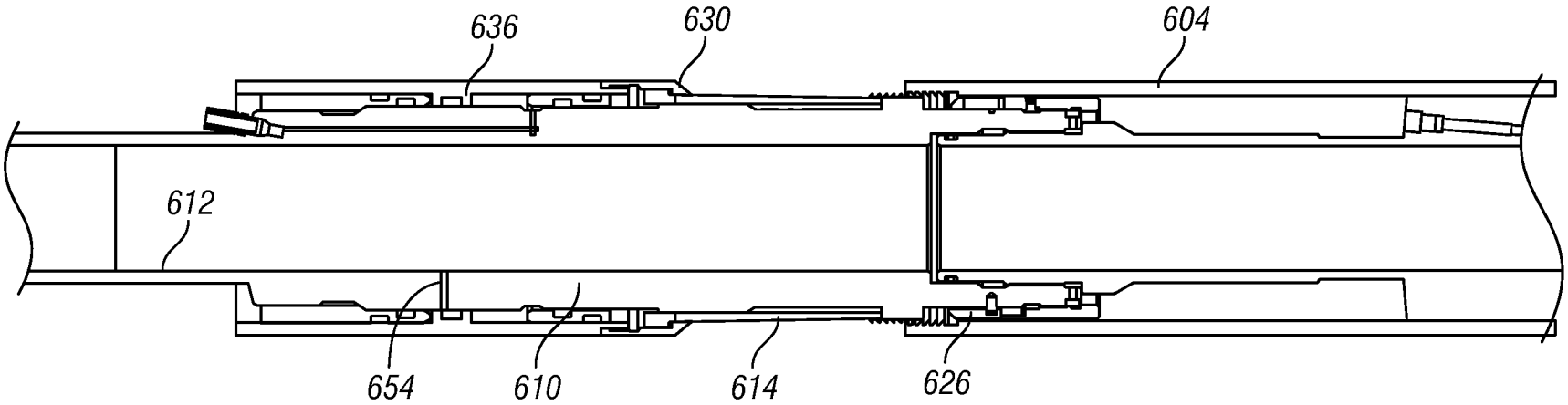
FIG. 7 shows a cross-sectional view of the releasable connection mechanism in FIG. 6 in accordance with one or more embodiments of the present disclosure.

In the above embodiment, the collet stop 230 may be locked into the engaged position, which would prevent the releasable connection mechanism 200 from being able to selectively disconnect or reconnect with the downhole tool 204 or other tubular members, tools, or components. However, the present disclosure is not so limited. FIGS. 6 and 7 show multiple cross-sectional views of a releasable connection mechanism 600 in accordance with one or more embodiments of the present disclosure. As with the above embodiment 200, the releasable connection mechanism 600 connects with a downhole tool 604 and includes a mandrel 610, a collet 614, a ring housing 626, a collet stop 630, and a piston 636 coupled to the collet stop 630. The releasable connection mechanism 600 disconnects from the downhole tool 604 similar to that of the releasable connection mechanism 600, by moving the collet stop 630 from the disengaged position, shown in FIG. 6, to the engaged position, shown in FIG. 7, and then applying tension between the releasable connection mechanism 600 and the downhole tool 604. The collet stop 630 is moved from the disengaged position to the engaged position in this embodiment by providing pressurized fluid to one side (e.g., downstream side) of the piston 636 through a port 650 and a flow path 652.

The collet stop 630, however, is not locked in the engaged position in this embodiment though, as no snap ring is present in this embodiment. Thus, the releasable connection mechanism 600 may be able to reconnect to the downhole tool 604 by positioning the releasable connection mechanism 600 within the downhole tool 604 and moving the collet stop 630 back from the engaged position to the disengaged position. The collet stop 630 is moved from the engaged position to the disengaged position in this embodiment by providing pressurized fluid to the other side (e.g., upstream side) of the piston 636 through a flow path 654. In this embodiment, pressurized fluid is provided to the flow path 654 through the flow passage 612 formed through the mandrel 610.

In one or more embodiments, a releasable connection mechanism in accordance with the present disclosure may be multi-configurable or reconfigurable for activation and use. For example, in FIGS. 6 and 7, pressurized fluid is provided through the port 650 to move the piston 636 and the collet stop 630 from the disengaged position to the engaged position, and pressurized fluid is provided through the flow passage 612 to move the piston 636 and the collet stop 630 from the engaged position to the disengaged position. However, in another embodiment, pressurized fluid may be provided through the mandrel flow passage 612 to move the piston 636 and the collet stop 630 from the disengaged position to the engaged position, and pressurized fluid may be provided through a port to move the piston 636 and the collet stop 630 from the engaged position to the disengaged position.

Figure 8:
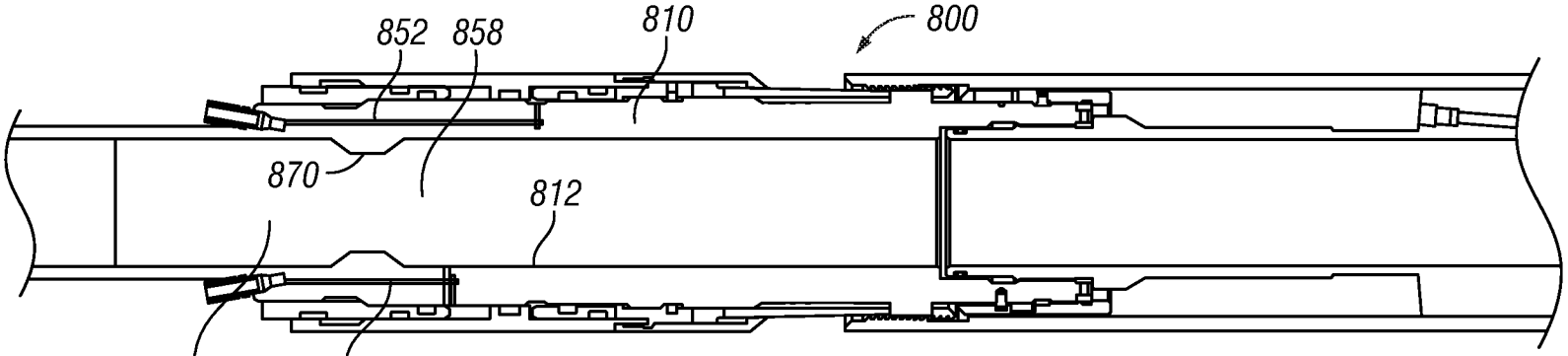
FIG. 8 shows a cross-sectional view of a releasable connection mechanism in accordance with one or more embodiments of the present disclosure.
Figure 9:
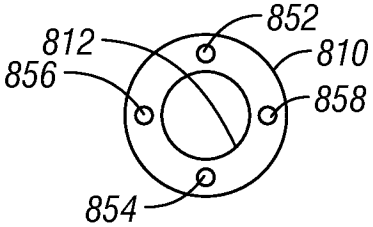
FIG. 9 shows a cross-sectional view of the releasable connection mechanism in FIG. 8 in accordance with one or more embodiments of the present disclosure.
Figure 10:
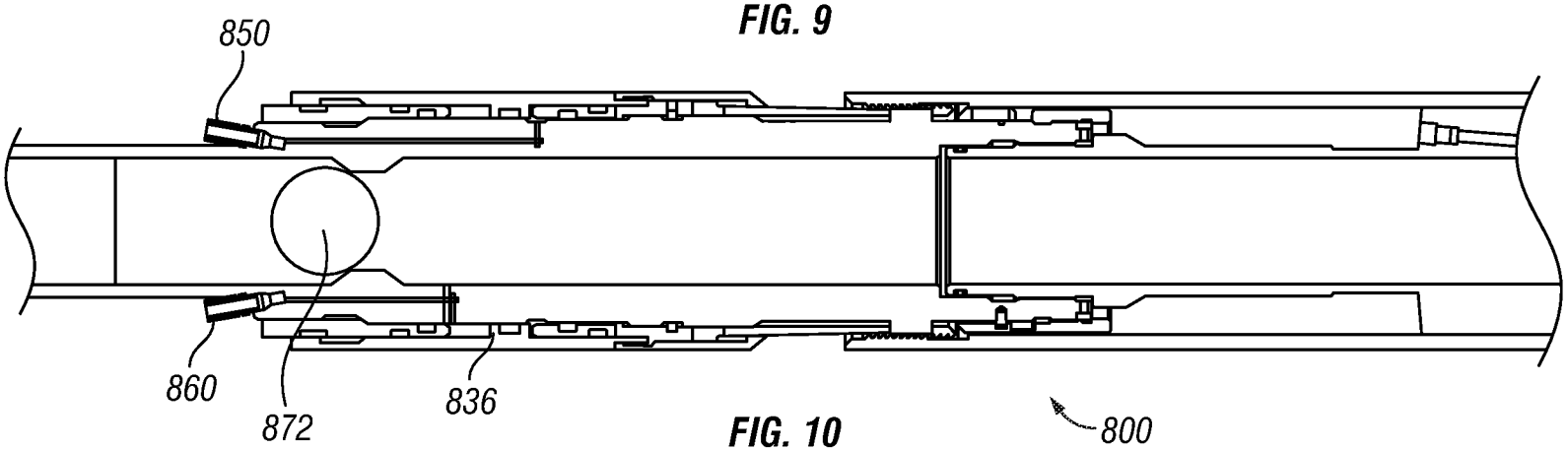
FIG. 10 shows a cross-sectional view of the releasable connection mechanism in FIG. 8 in accordance with one or more embodiments of the present disclosure.

FIGS. 8-10 show multiple views of a releasable connection mechanism 800 in which the releasable connection mechanism 800 may be multi-configurable or reconfigurable for activation and use, in accordance with one or more embodiments. In this embodiment, the releasable connection mechanism 800 may include a ball seat 870 formed within the flow passage 812 of the mandrel 810. FIG. 8, thus, shows the releasable connection mechanism 800 before a ball has landed on the ball seat 870, and FIG. 10 shows the releasable connection mechanism 800 after a ball 872 has landed on the ball seat 870.

Multiple flow passages and ports are also included with the releasable connection mechanism 800, and particularly may be formed within the mandrel 810. FIG. 9 shows a cross-sectional view of the mandrel 810 including flow passages 852, 854, 856, and 858. The flow passage 852 provides fluid communication between the exterior of the mandrel 810 (e.g., the port 850) and a downstream side of the piston 836, and the flow passage 854 provides fluid communication between the exterior of the mandrel 810 (e.g., the port 860) and an upstream side of the piston 836. Further, the flow passage 856 provides fluid communication between the exterior of the mandrel 810 and the flow passage 812 on an upstream side of the ball seat 870, and the flow passage 858 provides fluid communication between the exterior of the mandrel 810 and the flow passage 812 on a downstream side of the ball seat 870.

Fluid may be provided through the flow passage 858 and into the flow passage 812 of the mandrel 810, such as to unseat the ball 872 from the ball seat 870 and reverse circulate fluid flow for recovery of the ball 872. Fluid may also be provided through the flow passage 856 and into the flow passage 812 of the mandrel 810, such as if the ball seat 870 is shearable, to shear the ball seat 870 and move the ball 872 and ball seat 870 further downstream and through the releasable connection mechanism 800. In such an embodiment, a ball catcher may be installed or positioned downstream of the ball seat 870 to optionally retrieve the ball 872 and/or ball seat 870, if desired.

Further, one or more of the flow passages 852, 854, 856, and 858 may be in fluid communication with each other, such as to operate the releasable connection mechanism 800 as desired. For example, in one embodiment, the flow passage 852 may be in fluid communication with the flow passage 856, such as through a control line or jumper (not shown) connecting ports of the flow passages 852 and 856 to each other. In such an embodiment, pressurized fluid in the flow passage 812 of the mandrel 810 and upstream of the ball seat 870 may be communicated into the flow passage 856, through the control line or jumper, and into the flow passage 852 to move the piston 836 from the disengaged position to the engaged position. Similarly, the flow passage 854 may be in fluid communication with the flow passage 858, such as through another control line or jumper (not shown) connecting ports of the flow passages 854 and 858 to each other. In such an embodiment, pressurized fluid in the flow passage 812 of the mandrel 810 and downstream of the ball seat 870 may be communicated into the flow passage 858, through the control line or jumper, and into the flow passage 854 to move the piston 836 from the engaged position to the disengaged position. Accordingly, those having ordinary skill in the art will appreciate that other arrangements and configurations for the ports and flow passages of the releasable connection mechanism may be used without departing from the scope of the present disclosure.

A releasable connection mechanism in accordance with one or more embodiments of the present disclosure may provide one or more of the following advantages. The releasable connection mechanism may be used to deploy a variety of tubular members, tools, and assemblies downhole within a wellbore, and the releasable connection mechanism may be employed in a variety of existing technologies, including, but not limited to, polish bore assemblies, travel joints, and latching nipples. The releasable connection mechanism may be used to support the tail weight of the tubular string through the releasable connection mechanism, such as when lowering a completion downhole for installation. The releasable connection mechanism may be a pressure activated releasing mechanism and may be field configurable for any possible pressure differential combinations between the annulus (e.g., defined between the exterior of the releasable connection mechanism and the wellbore wall) and the flow passages interior and exterior to the releasable connection mechanism. The releasable connection mechanism may also be used to eliminate or reduce a slingshot effect (e.g., over-tensioning or over-pull) that may be caused by other devices that require shearing.

In addition to the embodiments described above, many examples of specific combinations are within the scope of the disclosure, some of which are detailed below:

Embodiment 1

A releasable connection mechanism for use downhole with a tubular member, comprising:

a collet configured to engage the tubular member;

a collet stop axially movable with respect to the collet between a disengaged position to not engage the collet and an engaged position to engage the collet;

a ring housing selectively axially movable with respect to the collet;

wherein, in the disengaged position, the collet is configured to move with respect to the ring housing to engage the ring housing and prevent the collet from disengaging the tubular member when the collet is tensioned with respect to the tubular member; and wherein, in the engaged position, the collet is configured to remain axially stationary with respect to the ring housing and disengage the tubular member when the collet is tensioned with respect to the tubular member.

Embodiment 2

The mechanism of Embodiment 1, wherein:

the collet is at least partially positioned within the tubular member; and the ring housing is positioned within the tubular member.

Embodiment 3

The mechanism of any Embodiment above, wherein the collet is radially flexible with respect to the tubular member so as to engage and to disengage the tubular member.

Embodiment 4

The mechanism of any Embodiment above, wherein:

the collet comprises a plurality of slots to define a plurality of fingers; and the collet engages the tubular member with the plurality of fingers.

Embodiment 5

The mechanism of any Embodiment above, further comprising a mandrel with the collet and the ring housing positioned about the mandrel, the mandrel comprising a recess formed on an outer surface to enable the collet to be flexible with respect to the mandrel.

Embodiment 6

The mechanism of any Embodiment above, wherein:

in the disengaged position, the collet is axially movable with respect to the mandrel; and in the engaged position, the collet is axially stationary with respect to the mandrel.

Embodiment 7

The mechanism of any Embodiment above, wherein, in the engaged position, the collet stop engages a shoulder of the collet.

Embodiment 8

The mechanism of any Embodiment above, further comprising:

a shearable element engageable with the ring housing and configured to shear at a predetermined amount of force to allow the collet to disengage the tubular member; and a snap ring engageable with the collet stop when the collet stop is moved to the engaged position to lock the collet stop in the engaged position.

Embodiment 9

The mechanism of any Embodiment above, further comprising a piston coupled to the collet stop to move the collet stop with respect to the collet from the disengaged position to the engaged position.

Embodiment 10

The mechanism of any Embodiment above, wherein the tubular member comprises a threaded surface and the collet comprises teeth configured to engage the threaded surface.

Embodiment 11

The mechanism of any Embodiment above, wherein the tubular member comprises a downhole tool.

Embodiment 12

A method for disconnecting a releasable connection mechanism from a tubular member in a well, comprising:

positioning the tubular member within the well;

axially moving a collet stop with respect to a collet of the releasable connection mechanism from a disengaged position to an engaged position engaging the collet; and tensioning the collet with respect to the tubular member, thereby disconnecting the collet of the releasable connection mechanism from the tubular member to deploy the tubular member within the well.

Embodiment 13

The method of Embodiment 12, further comprising:

engaging the collet of the releasable connection mechanism with the tubular member to connect the collet to the tubular member; and removing the tubular member from the well with the releasable connection mechanism.

Embodiment 14

The method of Embodiment 12-13, wherein, when tensioning the collet with respect to the tubular member before moving the collet stop to the engaged position, the method comprises the collet engaging a ring housing of the releasable connection mechanism to prevent the collet from disengaging the tubular member.

Embodiment 15

The method of Embodiment 12-14, wherein the moving the collet stop comprises providing pressurized fluid against a piston coupled to the collet stop to move the piston and the collet stop with respect to the collet.

Embodiment 16

The method of Embodiment 12-15, wherein the tubular member comprises a downhole tool.

Embodiment 17

A releasable connection mechanism for use downhole, comprising:

a mandrel comprising a flow passage formed through the mandrel;

a collet positioned about the mandrel;

a ring housing positioned about the mandrel with the collet selectively engageable with the ring housing;

a collet stop axially movable with respect to the collet between a disengaged position to not engage the collet and an engaged position to engage the collet such that, in the engaged position, the collet stop prevents the collet from engaging the ring housing.

Embodiment 18

The mechanism of Embodiment 18, wherein:

the collet is configured to engage with a tubular member;

in the disengaged position, the collet is configured to move with respect to the ring housing to engage the ring housing and prevent the collet from disengaging the tubular member when the collet is tensioned with respect to the tubular member; and in the engaged position, the collet is configured to remain axially stationary with respect to the ring housing and disengage the tubular member when the collet is tensioned with respect to the tubular member.

Embodiment 19

The mechanism of Embodiment 18-19, wherein:

in the disengaged position, the collet is axially movable with respect to the mandrel; and in the engaged position, the collet is axially stationary with respect to the mandrel.

Embodiment 20

An apparatus for use downhole, comprising:

a mandrel comprising a bore formed through the mandrel and a seat protruding into the mandrel bore;

a piston positioned about and movable with respect to the mandrel;

a first piston flow passage formed within the mandrel and in fluid communication with one side of the piston to move the piston in one direction with respect to the mandrel;

a second piston flow passage formed within the mandrel and in fluid communication with the other side of the piston to move the piston in the opposite direction with respect to the mandrel;

a first seat flow passage formed within the mandrel and in fluid communication with one side of the mandrel bore with respect to the seat; and a second seat flow passage formed within the mandrel and in fluid communication with the other side of the mandrel bore with respect to the seat;

wherein the first piston flow passage is in fluid communication with one of the first seat flow passage and the second seat flow passage; and wherein the second piston flow passage is in fluid communication with the other of the first seat flow passage and the second seat flow passage.

One or more specific embodiments of the present disclosure have been described. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

In the following discussion and in the claims, the articles "a," "an," and "the" are intended to mean that there are one or more of the elements. The terms "including," "comprising," and "having" and variations thereof are used in an open-ended fashion, and thus should be interpreted to mean "including, but not limited to . . . ." Also, any use of any form of the terms "connect," "engage," "couple," "attach," "mate," "mount," or any other term describing an interaction between elements is intended to mean either an indirect or a direct interaction between the elements described. In addition, as used herein, the terms "axial" and "axially" generally mean along or parallel to a central axis (e.g., central axis of a body or a port), while the terms "radial" and "radially" generally mean perpendicular to the central axis. The use of "top," "bottom," "above," "below," "upper," "lower," "up," "down," "vertical," "horizontal," and variations of these terms is made for convenience, but does not require any particular orientation of the components.

Certain terms are used throughout the description and claims to refer to particular features or components. As one skilled in the art will appreciate, different persons may refer to the same feature or component by different names. This document does not intend to distinguish between components or features that differ in name but not function.

Reference throughout this specification to "one embodiment," "an embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A method for disconnecting a releasable connection mechanism from a tubular member in a well, comprising:

positioning the tubular member within the well; then separating a collet of the releasable connection mechanism from a ring housing of the releasable connection mechanism while maintaining engagement between the collet and the tubular member; then axially moving a collet stop of the releasable connection mechanism with respect to the collet from a disengaged position to an engaged position to prevent relative axial movement between the collet, the collet stop, and the ring housing while maintaining engagement between the collet and the tubular member; and then applying tension to the releasable connection mechanism while the collet stop is in the engaged position to disengage the collet of the releasable connection mechanism from the tubular member to deploy the tubular member within the well.

2. The method of claim 1, further comprising:

engaging the collet of the releasable connection mechanism with the tubular member to connect the collet to the tubular member; and removing the tubular member from the well with the releasable connection mechanism.

3. The method of claim 2 further comprising engaging the collet with the ring housing of the releasable connection mechanism to prevent the collet from disengaging the tubular member.

4. The method of claim 3, further comprising shearing a shearable element engaged with the ring housing to disengage the tubular member.

5. The method of claim 4, wherein the shearable element is configured to shear at a predetermined amount of force.

6. The method of claim 3, wherein the step of collet engaging the ring housing of the releasable connection mechanism to prevent the collet from disengaging the tubular member further comprises allowing axial movement of the collet with respect to the ring housing.

7. The method of claim 3, further comprising positioning the ring housing within the tubular member.

8. The method of claim 3, wherein the collet is radially flexible with respect to the tubular member.

9. The method of claim 8, further comprising positioning the ring housing about a mandrel comprising the collet.

10. The method of claim 9, wherein the mandrel comprises a recess formed on an outer surface to enable the collet to be flexible with respect to the mandrel.

11. The method of claim 8, wherein the collet comprises a plurality of slots to define a plurality of fingers.

12. The method of claim 11, further comprising engaging the tubular member with the plurality of fingers.

13. The method of claim 1, wherein the step of moving the collet stop further comprises providing pressurized fluid against a piston coupled to the collet stop to move the piston and the collet stop with respect to the collet.

14. The method of claim 1, wherein the tubular member comprises a downhole tool.

15. The method of claim 1, further comprising engaging a snap ring with the collet stop when the collet stop is moved to the engaged position to lock the collet stop in the engaged position.

16. The method of claim 1, wherein the tubular member comprises a threaded surface and the collet comprises teeth, and the method further comprises engaging the threaded surface with the teeth.

17. The method of claim 1, wherein the step of axially moving the collet stop with respect to a collet of the releasable connection mechanism from the disengaged position to the engaged position where the collet stop engages the collet further comprises engaging a shoulder of the collet with the collet stop.

18. The method of claim 1, further comprising positioning the collet at least partially within the tubular member.

19. The method of claim 1, wherein the step of tensioning the collet with respect to the tubular member, thereby disconnecting the collet of the releasable connection mechanism from the tubular member to deploy the tubular member within the well further comprises preventing axial movement of the collet with respect to the tubular member.

* * * * *